US005129992A

United States Patent [19]

Schiel et al.

[11] Patent Number: 5,129,992

[45] Date of Patent: Jul. 14, 1992

[54] STATIONARY SUPPORT DEVICE FOR DRAINAGE WIRE

[75] Inventors: Christian Schiel, Heidenheim; Helmut Grimm, Ellwangen, both of Fed. Rep. of Germany

[73] Assignee: J. M. Voith GmbH, Fed. Rep. of Germany

[21] Appl. No.: 708,391

[22] Filed: May 31, 1991

[30] Foreign Application Priority Data

Jun. 22, 1990 [DE] Fed. Rep. of Germany ..... 4019921

[51] Int. Cl.[5] ..... D21F 1/54

[52] U.S. Cl. ..... 162/352; 162/374

[58] Field of Search ..... 162/352, 354, 374

[56] References Cited

U.S. PATENT DOCUMENTS

| | | | |
|---|---|---|---|
| 3,017,930 | 1/1962 | Dunlap | 162/352 |
| 3,027,940 | 4/1962 | Dunlap | 162/352 |
| 4,184,915 | 1/1980 | Metcalf | 162/352 |
| 4,865,692 | 9/1989 | Kade et al. | 162/352 |

*Primary Examiner*—Karen M. Hastings

*Attorney, Agent, or Firm*—Ostrolenk, Faber, Gerb & Soffen

[57] ABSTRACT

A stationary support device for the drainage wire screen of a fiber web forming section. The cover ledge over which the drainage screen passes has a front edge which the screen passes and then the drainage surface beneath the wire screen diverges from the wire screen in the wire screen advancing direction. The cover ledge is of hard material. The front part of the cover ledge is supported by a support at a rigid pivot joint. The rearward part of the cover ledge is supported by wedge surface connections for permitting adjustment of the tilt orientation of the cover ledge with respect to the drainage wire. Leaf type clamping springs disposed between the cover ledge and the support, disposed rearwardly of the front joint and disposed forwardly of the wedge surface connections. The clamping leaf springs being connected to the cover ledge by tie rods at the center of the spring and to the support by tie rods at the ends of the springs. In an alternate embodiment, the clamping element is an expandable pressure hose connected at opposite sides by tie rods to the cover ledge and to the support. A ball and socket joint enables the slide disk and the wedge shaped angle inclination surfaces to seat together.

21 Claims, 2 Drawing Sheets

STATIONARY SUPPORT DEVICE FOR DRAINAGE WIRE

BACKGROUND OF THE INVENTION

The present invention relates to a stationary support device for a revolving water drainage wire screen, and particularly for the wire of a paper machine, and particularly relates to means for adjusting and fixing the tilt angle of the drainage surface beneath the wire.

Prior art references bearing on this include:

1. Federal Republic of Germany published application 36 28.282 Al—a Priority Application for reference 3 below, including part of reference 3 plus, in addition, FIGS. 8, 9;

2. Federal Republic of Germany published application 38 00 801 Al—(also part of reference 3);

3. British Application 2 194 257 A, equivalent to U.S. Pat. No. 4,865,692; and

4. U.S. Pat. No. 3,027,940 which was cited in reference 3.

Many of the features described below are known from FIG. 1 of Federal Republic of Germany 38 00 801 Al, which is equivalent FIG. 8 of British Application 2 194 257 A.

Stationary support devices of this type particularly serve for supporting the revolving wire screen on which a fiber web is formed from a fiber suspension which continuously flows onto the wire. The support device has a drainage surface beneath the wire which is on a head ledge. In addition, a scrapper-like front or upstream edge of the head ledge of the support device leads away the so called white water which has passed through the openings of the wire screen and out of the fiber web which is being formed and which adheres to the bottom of the wire At the same time, due to the inclination of the drainage surface of the head ledge relative to the direction of travel of the wire, a vacuum is produced at the bottom of the revolving wire, which increases the drainage. The intensity or rate of this drainage depends on the angle of inclination of the drainage surface.

In paper making machines in which the operating conditions change frequently, for instance, changes of the type of paper being produced, or changes in the speed of operation or the like, a change in the angle of incline of the drainage surface at the stationary support device is frequently necessary. Therefore, for a long time there have been efforts to find a dependable design for changing this angle of incline.

With the above noted known construction, it has been tried, in particular, to make that angle of incline, that is the angle between the drainage surface and the direction of travel of the wire above that surface, reproducible with a high degree of precision. Furthermore, it was desired that the stationary support device be as free of vibration as possible. In order to achieve these goals, as shown, for example, in U.S. Pat. No. 4,865,692, the joint between the leading or front edge of the means on which the drainage surface is defined and the support at the front end region is formed as a spring plate. Furthermore, the clamping element, which clamps together stop surfaces which establish the angle of incline, is developed as an expandable hose The clamping hose acts, on the one hand, so that the joint at the front end or leading end region is under tensile stress and so that, on the other hand, the pair of cooperating stop surfaces that define the tilt angle of the drainage surface are held in continuous contact with each other. The pairs of stop surfaces are formed by at least one wedge rod having a series of wedge sections which cooperate with the other set of stop surfaces to transmit only compressive forces.

One disadvantage of this known construction is that the joint at the front or leading end, which is formed as a spring plate, does not form a precise hinge axis. Upon a change of the angle of incline, the movement of the head ledge cannot be predicted with sufficient assurance. Another disadvantage is that both the moveable support ledge and the rigid support are developed as two C-shaped beams which interleave and engage into each other In this way, heavy parts of complicated shape are necessary, resulting in a relatively high expense of manufacture and a relatively large structural height.

FIGS. 8 and 9 of Federal Republic of Germany published application 36 28 282 Al disclose a tilt angle adjustment device of lesser height, in the form of a C-shaped adjustment ledge, which is under tensile stress. Its manufacture is difficult and costly. Furthermore, there is again a spring plate joint which is under tensile stress.

SUMMARY OF THE INVENTION

The object of the present invention is to improve the known stationary support device for a drainage wire screen to satisfy the following requirements:

1. Its cross-sectional dimensions, particularly both its width and the height, should be as small as possible 2. The joint between the moveable cover ledge, with a head ledge, on which the drainage surface is defined, and the rigid support for the movable cover ledge, should have a precisely located hinge axis and should also be of simpler shape than previously.

3. The known wedge bar, e.g. as in U.S. Pat. No. 4,865,692, which transmits only compressive forces, should be retained as an adjusting device.

This object is achieved generally by the following features.

A stationary support device for the drainage wire screen, i.e. a wire, of a fiber web forming section includes a cover ledge over which the drainage screen passes That ledge has a leading, upstream, or front edge which the wire first passes, and the following drainage surface beneath the wire diverges from the wire in the wire advancing direction. The cover ledge is of hard undeflectable material. The front side of the cover ledge is supported at a rigid pivot joint and a rigid support. The trailing, downstream or rearward part of the cover ledge is supported by wedge surface connections, which permit adjustment of the tilt orientation of the cover ledge with respect to the drainage wire. The wedge surface connections comprise a plurality of wedge inclined surfaces along a ledge or beam and stop projections opposed to the wedge surfaces The wedge ledge is on one of the cover ledge and the stationary support, while the stop projections are on the other.

A clamping spring is disposed between the cover ledge and the rigid support, is disposed rearwardly of the front joint and is disposed forwardly of the wedge surface connections for angle adjustment. The clamping spring is attached by first tie means to the tilt angle adjustable cover ledge and by second tie means to the nontiltable support. In particular, the clamping spring comprises a plurality of leaf springs that are connected to the cover ledge by first tie rods that are secured at the center of each leaf spring and to the support that are secured by second tie rods at the ends of each leaf spring. In an alternate embodiment, the clamping element is a hose connected at its opposite sides by tie rods to the cover ledge and to the support. Each stop projection may rest via a slide disk on one of the wedge inclined surfaces. The slide disk may be connected to the stop projection by a ball and socket joint, which is on one of the cover ledge and the support. This enables the slide disk to engage the wedge shaped angle inclination surface on the other of the cover ledge and the support so that the slide disk and the surface may seat together at the wedge angle.

One inventive concept resides in a combination of a fixed position, tongue-in-groove joint for the coupling of the front end of the moveable cover ledge to the rigid support, with a plurality of tensile clamping elements which are distributed over the length of the support device. The clamping elements exert pulling forces on the moveable cover ledge so as to both pull the ledge firmly against the tongue-in-groove joint and to keep the sets of stop surfaces in continuous contact with each other. In order to avoid play or backlash and to obtain a simple compact arrangement, according to the invention, the tensile clamping elements act on the moveable cover ledge between the joint at the front side and the pairs of stop surfaces toward the rear side, as seen in a longitudinal cross section through the supporting device along the path of advancing of the wire.

One essential advantage of the combination of features of the invention is that the stationary support device can be formed from simple parts. In particular, the previously used, complicated, interengaging C-shaped supports can be dispensed with. Thus, the structural height of the support device of the invention is also relatively small, similar to the known construction of FIGS. 8 and 9 of Federal Republic of Germany published application 36 28 282 Al. However, in contrast to that known construction, it is possible with the invention to avoid using special leaf spring joints. This makes it possible for the entire inside volume of the stationary support device to be available for containing amply dimensioned pairs of cooperating, inclination angle adjusting, stop surfaces, preferably using a known wedge ledge, and those stop surfaces can be protected from pulp or water by a covering Nevertheless, there is also ample space within the support device for an alternate form of stop surface clamping element in the form of a pressure hose or in the form of a plurality of springs, as explained further below, and also formed using tie rods.

U.S. Pat. No. 3,027,940 discloses a stationary support device having a tongue-in-groove joint for connecting a cover ledge with a rigid support. In contrast to the present invention, that cover ledge is deformable, so that a change in the angle of inclination of the drainage surface is effected by deforming the cover ledge. The drainage surface is curved, so that its radius of curvature can be varied. A curved drainage surface, however, has the disadvantage that the drainage of the web of paper produced on the wire takes place in a non-uniform manner over the cross machine width of the paper making machine, similar to what occurs upon the support of the wire by means of wire-carrying rolls. Another disadvantage of this known construction is that a plurality of screws, which are distributed over the cross machine width of the support device, are provided as pairs of stop surfaces. They must be adjusted individually to change the angle of inclination of the drainage surface. It is therefore not possible to establish a given angle of inclination in a reproducible manner with the required precision during the operation of the paper making machine.

There are other advantageous embodiments of the invention. An expandable pressure hose can be provided as a clamping element, as heretofore However, a plurality of springs and particularly leaf springs, distributed over the length of the support device is the preferred clamping element. The springs are preferably developed as leaf springs, which extend approximately in the cross machine direction of the support device. Substantially trapezoidally shaped leaf springs are particularly suitable because the ends of adjacent leaf springs can overlap each other laterally. This permits the use of leaf springs of relatively large effective length, but at the same time the springs take up only a small amount of space.

Other objects and features of the present invention are described below with reference to the drawings.

DESCRIPTION OF THE PREFERRED EMBODIMENTS

Figure 1:
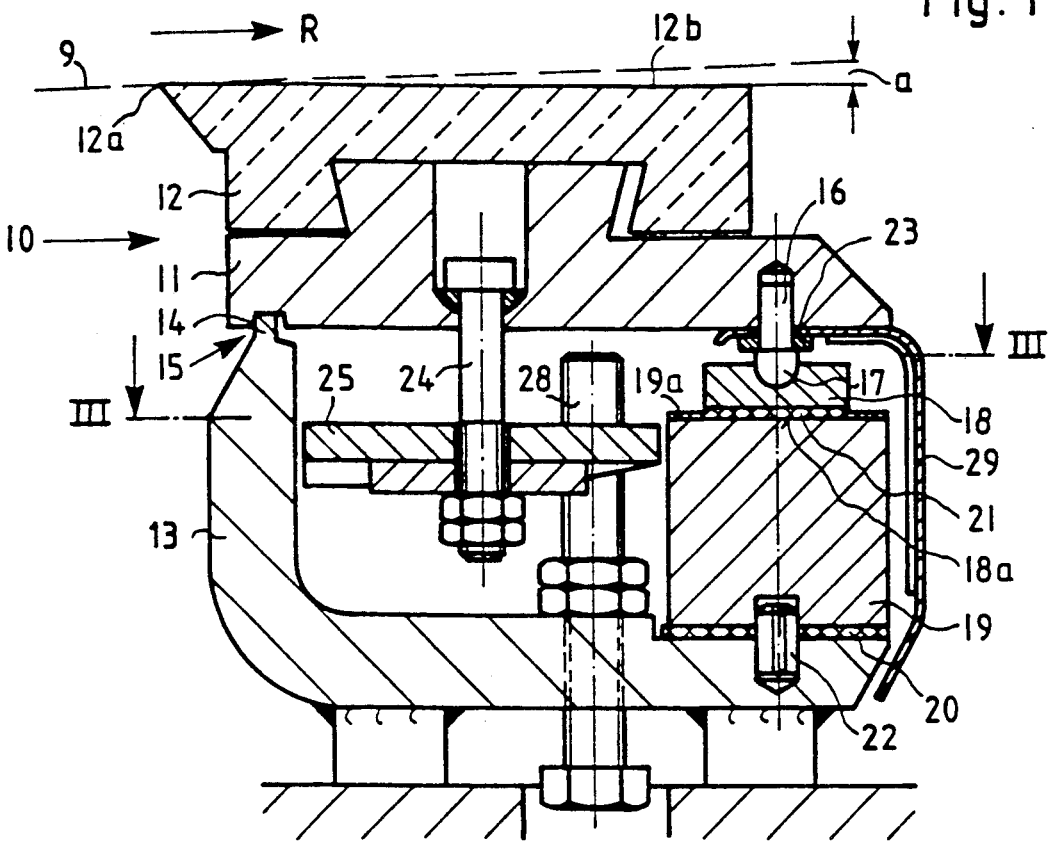
FIG. 1 shows a stationary support device viewed in longitudinal cross section with reference to the travel direction of a wire screen.
Figure 2:
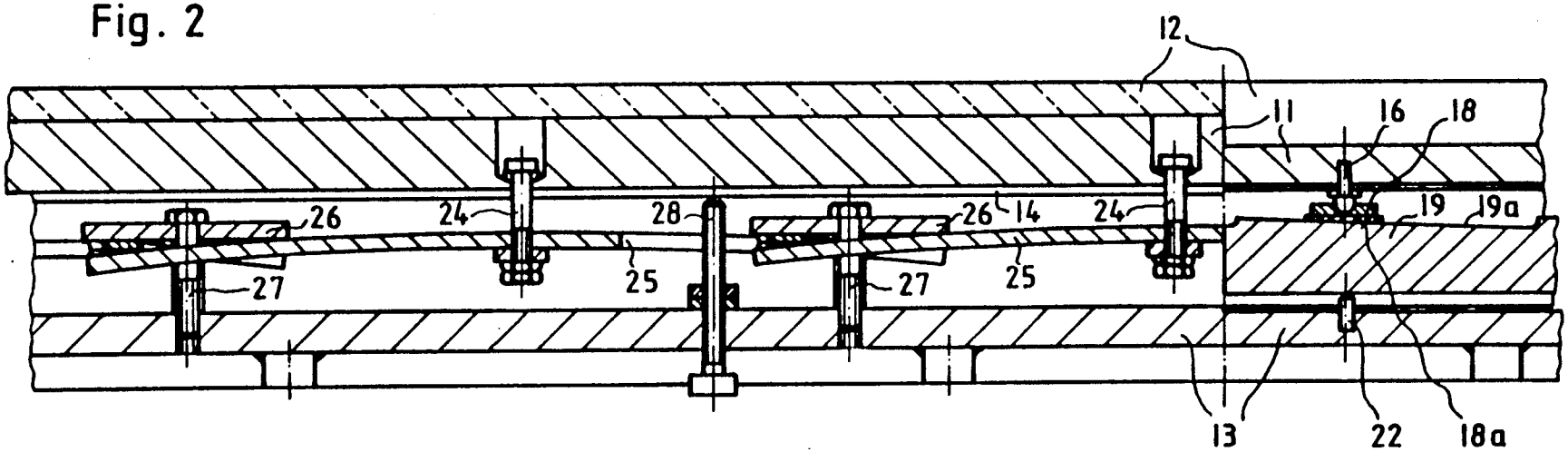
FIG. 2 shows two different elevational and transverse sections with reference to the direction of wire travel, along the lines II—II of FIG. 3.
Figure 3:
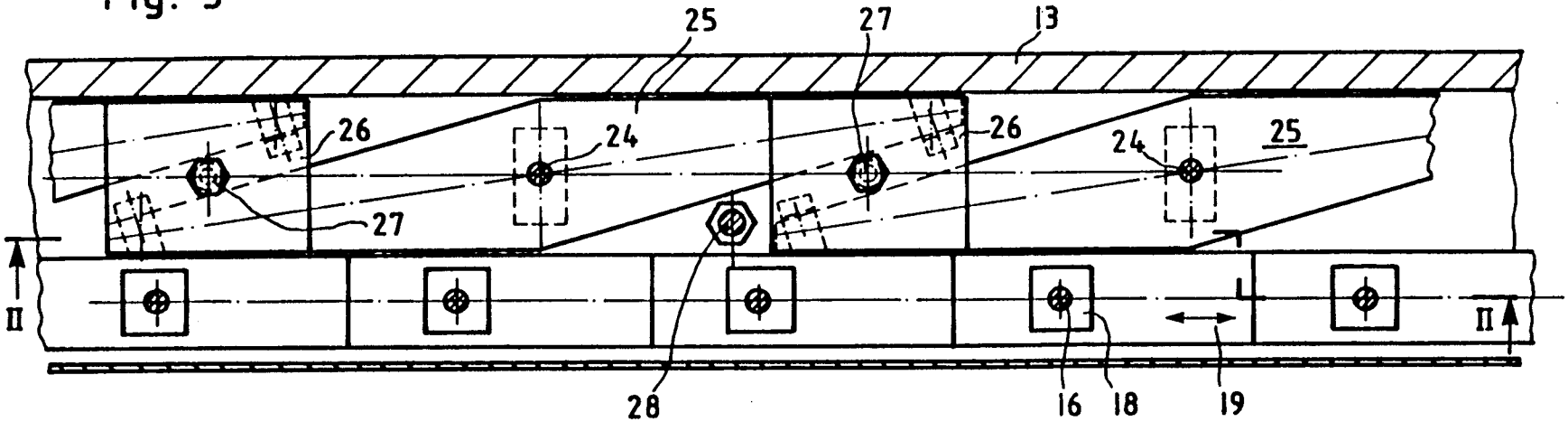
FIG. 3 is a horizontal transverse section along the line III—III of FIG. 1.

The stationary support device shown in FIGS. 1 to 3 has a cover ledge 10, which extends in the cross machine direction, transversely to the direction of travel (arrow R) of a wire drainage screen or wire 9 of a paper making machine wire drainage section, or the like installation. The cover ledge 10 comprises a moveable support ledge 11 below and a head ledge 12 which is arranged atop the support ledge 11, and the ledges are held together by a dovetail connection. The head ledge is formed of a hard, wear resistant material.

Figure 4:
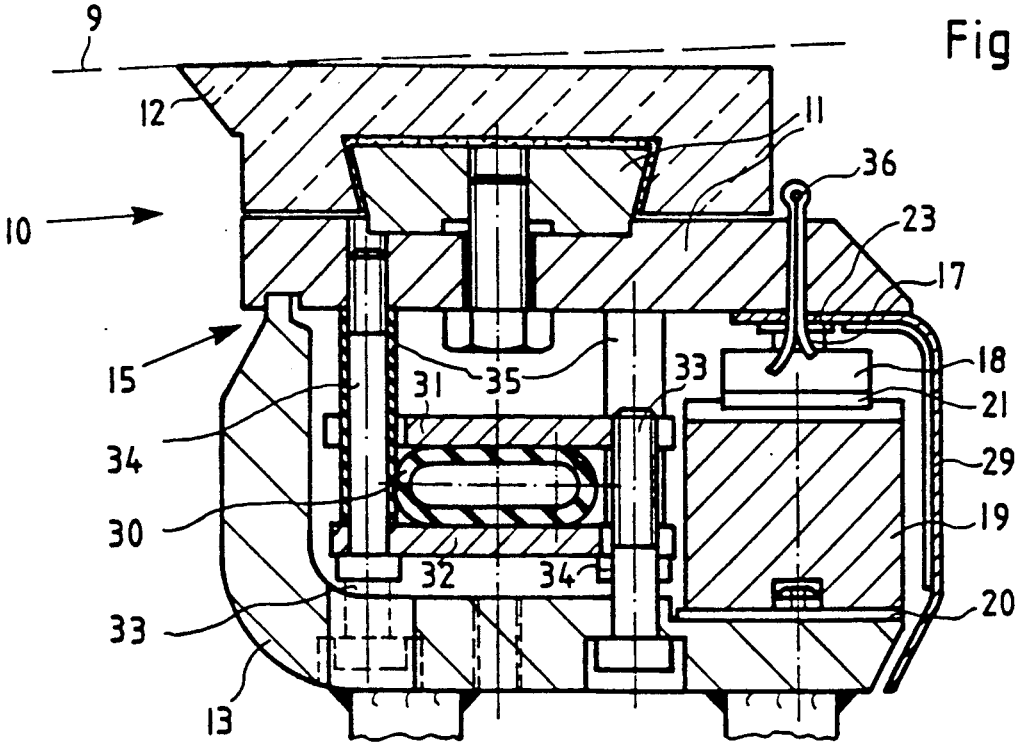
FIG. 4 shows a cross section of an embodiment which differs from FIGS. 1 to 3.

The head ledge 12 has a scraper-like front, leading or upstream edge 12*a* which contacts the wire 9, and preferably the bottom surface of the wire. A drainage surface 12*b* meets and follows downstream from the front edge 12*a* and forms a small variable angle of inclination a with respect to the path and direction of travel R of the wire 9. In FIG. 1, the entire drainage surface 12*b* lies in a single plane. One can, however, also deviate from this in known manner. In FIGS. 1 and 4, the direction of travel R of the wire 9 is shown as approximately horizontal. The travel direction of the wire may alternatively be inclined or be vertical. The orientation and position of installation of the support device is adapted to the travel direction of the wire.

The moveable cover ledge 10 rests on a rigid support 13. The support 13 has an L-shaped cross section, as seen in the longitudinal direction in FIG. 1. The upstanding, front arm of the rigid support 13 extends in the direction up toward the cover ledge 10. At its free upper end, the support front arm has a narrow tongue 14 which engages into a groove of slightly greater width beneath the moveable support ledge. The tongue 14 and the groove form a tongue-in-groove joint 15, which is arranged in the region of the front edge 12a of the head ledge 12. For a horizontal direction of travel R of the wire, the joint 15 lies below the ledge front edge 12a. The tongue 14 and its groove are shown with rectangular cross sections. However, other shapes, for instance, a semicircular cross section, can be used.

In the region toward the rear of or downstream along the support device, the moveable support ledge 11 is supported by a plurality of pins 16. Each pin 16 has a spherically rounded bottom head 17, which rests via a slide disk 18 on a respective wedge inclined surface of the wedge ledge 19, and that ledge in turn, rests on the rigid support 13. The wedge ledge 19 has a series of wedge shaped surfaces, each for engaging one slide disk. The wedge ledge extends lengthwise, in the cross machine direction, over the entire support device. It is displaceable in its longitudinal direction, across the width of the support ledge 11. The wedge ledge 19 is slidable between upper and lower, plate shaped, slide pieces 20 and 21 which have low friction surfaces, e.g. plastic coatings or similar intermediate layers, which reduce the frictional resistance to movement of the wedge ledge. For guiding the movement of the wedge ledge 19, a plurality of dowel pins 22 are inserted in the support 13. The dowels 22 engage in a longitudinal groove formed in the bottom side of the wedge ledge By means of the pins 16 and a respective spacer disk 23 for each pin 16, a cover plate 29 is fastened to the moveable support ledge 11 in order to protect the inside of the wedge ledge 19 from being dirtied by pulp or drained off water. The thickness of the various spacer disks 23, which are distributed over the cross machine width of the support device, may differ if necessary. Especially in case of possible inaccuracies in manufacture, the angle of incline of the cover ledge 10 can be established precisely, uniformly over the cross machine width.

As seen in FIG. 2, the wedge ledge 19 has a plurality of inclined stop surfaces 19a, one of which is shown at the right in FIG. 2. Each stop surface is correspondingly inclined along the cross machine width direction. Each surface 19a is in contact with a stop surface 18a of a respective one of the slide disks 18 for that stop surface 19a. It is important that the slide disk 18 always contact the wedge ledge 19 flatly. This contact angle is assured by the spherically curved bottom head 17 of the pin 16 which engages into the slide disk.

In order that the moveable cover ledge 10 might be definitely pressed against both the joint 15 at the front edge and the wedge ledge 19 toward the rear, a plurality of tie rods 24 are distributed over the cross machine width of the support device and are located generally in the central region of the longitudinal cross section of the moveable support ledge 11. A clamping element, in the form of a leaf spring 25, acts on each tie rod (in the embodiment according to FIGS. 1 to 3). In FIG. 3, each leaf spring 25 has the shape of a slender parallelogram which extends in the cross machine direction. The central region of each leaf spring 25 is connected via the upper tie rod 24 with the moveable cover ledge 11. The opposite ends of adjacent leaf springs 25 overlap each other laterally, and the overlapping end regions are covered by a common rectangular shape spring clamping plates 26. Each spring clamping plate 26 is engaged by a common lower tie rod 27 which is screwed into the rigid support 13. This tensions the leaf springs 25.

Upon the assembly of the support device, the cover ledge 10 initially rests only on the joint 15 and on a few auxiliary mounting screws 28 which are distributed over the cross machine width of the support device because the wedge ledge 19, the slide disks 18 and the cover plate 29 are initially absent. These parts are only later installed after the leaf springs 25 and the spring clamping plates 26 have been pretensioned by the tie rods 24 and 27. The auxiliary mounting screws 28 are finally spaced a distance away from the moveable support ledge 11, as shown in FIGS. 1 and 2.

In the embodiment shown in FIG. 4, instead of the leaf springs serving for the clamping, an expandable hose 30 is provided as the clamping element. The hose extends over the entire cross machine length of the support device. Above the hose 30 is positioned a stationary force transmission ledge 31. Below the hose is positioned a moveable force transmission ledge 32. Both force transmission ledges extend in the cross machine direction also substantially through the entire support device. The hose 30 lies between the two force transmission ledges 31 and 32. Upon the hose 30 being pressurized, the hose spreads the two force transmission ledges 31 and 32 apart in the vertical direction.

One plurality of lower tie rods 33 connect the stationary force transmission ledge to the rigid support 13'. A second plurality of upper tie rods 34 connect the moveable force transmission ledge 32 to the moveable support ledge 11'. Because the moveable force transmission ledge 32 is below the hose 30 and the stationary force transmission ledge 31 is above the hose, cutouts for passage of the tie rods 33 and 34 are provided in the force transmission ledges. In order to obtain uniform spacing between the moveable force transmission ledge 32 and the moveable support ledge 11', spacing bushings 35 are provided for the tie rods 34. For attaching the cover plate 29, several cotter pins 36 are also provided Other essential details of the embodiment in FIG. 4 correspond to those of the embodiment of FIG. 1 and are therefore provided with the same reference numerals.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A stationary support device for an endless drainage wire screen of a machine for producing a fiber web from fibrous stock, the device comprising:

a nondeformable cover ledge past which the wire screen is movable in an advancing direction, the cover ledge having a drainage surface past which the wire screen is moved, the cover ledge, at least near the drainage surface, being comprised of a hard, non-bendable material;

the drainage surface of the cover ledge having a front part with a front edge which is the edge first passed by the moving wire screen and over which the wire screen slides; rearward of the front edge, the cover ledge being at an angle of inclination with respect to the wire screen, the separation between the drainage surface and the wire screen increasing rearwardly of the front edge of the drainage surface;

a rigid, non-moving L-shaped support for the cover ledge, the support including a rigid, non-moving front part which projects toward the front part of the cover ledge on the side thereof that is opposite the drainage surface thereof;

the front part of the cover ledge including means for cooperating with the front part of the rigid support for defining a tongue-in-groove joint at a front side of the device between the front part of the rigid support and the cover ledge, the tongue-in-groove joint being shaped for permitting the cover ledge to pivot around the joint at the front part of the rigid support;

cooperating first stop means on the cover ledge and second stop means on the support, the first and second stop means being adjustable with respect to each other for varying the angle of inclination of the cover ledge with respect to the path of the wire past the cover ledge; the first and second stop surfaces being located rearward in the path of the wire screen past the drainage surface toward a rear side of the device;

clamping means for clamping the first and second stop means into contact with each other for firmly setting the angle of inclination of the drainage surface; the clamping means including a clamping element disposed between the cover ledge and the support and being disposed rearward of the joint and forward of the stop means.

2. The device of claim 1, wherein the clamping means comprises a clamping element disposed between the cover ledge and the support and adapted for normally urging the cover ledge toward the support;

first means for tying the clamping element to the cover ledge and second means for tying the clamping element to the support.

3. The device of claim 2, wherein the first tying means comprises a first plurality of tie rods distributed over the cross machine width of the cover ledge for tying the clamping element to the cover ledge, and the second tying means comprises a second plurality of tie rods extending over the cross machine width of the support for tying the clamping element to the support;

the tie rods being located in a space between the support and the cover ledge and the stop means.

4. The device of claim 1, wherein the tongue-in-groove joint is adapted for transmitting only compressive forces.

5. The device of claim 1, wherein the tongue of the tongue-in-groove -joint is on the front part of the support and the groove which receives the tongue is defined in the front part of the cover ledge.

6. The device of claim 1, wherein the cover ledge is comprised of a support ledge which is engaged by the clamping means, which carries the first stop means and at which the joint is defined; the cover ledge further comprises a head ledge which is supported to the support ledge and on which the drainage surface is defined.

7. The device of claim 1, wherein the cover ledge and the joint extend fully across the width of the device.

8. The device of claim 1, wherein the first stop means comprises a plurality of first stop surfaces and the second stop means comprises a respective plurality of second stop surfaces, and a respective one of the first stop surfaces engages each of the second stop surfaces, at least one of the first and second pluralities of stop surfaces comprising a corresponding plurality of inclined wedge surfaces, and all said wedge surfaces are inclined in the same direction along the width of the device, such that cooperation between the first and second stop surfaces determines the angle of inclination of the cover ledge;

means supporting at least one of the first and second stop surfaces for moving across the width of the device for adjusting the angle of inclination of the cover ledge.

9. The device of claim 2, wherein there are a plurality of the clamping elements, each comprising a respective spring and the springs are distributed over the width of the device, the tying means being the exclusive connection between the springs and the cover ledge, on the one hand, and the springs and the rigid support, on the other hand.

10. The device of claim 3, wherein there are a plurality of the clamping elements, each comprising a respective spring and the springs are distributed over the width of the device, the tie rods being the exclusive connection between the springs and the cover ledge, on the one hand, and the springs and the rigid support, on the other hand.

11. The device of claim 10, wherein each spring is a leaf spring extending approximately in the direction across the device.

12. The device of claim 11, wherein each leaf spring has a generally central region in the direction across the device and each spring has opposite ends in the direction across the device; the first tie rods from the leaf springs to the cover ledge are connected generally at the respective central regions of the leaf springs and the second tie rods between the leaf spring and the support are generally connected at the ends of the leaf spring.

13. The device of claim 11, wherein each leaf spring has a generally central region in the direction across the device and each spring has opposite ends in the direction across the device; the first tie rods are connected to one of either the central region of the leaf spring and the ends of the leaf spring while the second tie rods are connected to the other of the central region of the leaf spring and the ends of the leaf spring.

14. The device of claim 13, wherein there is a respective common tie rod connecting the ends of the adjacent leaf springs where they overlap to the support.

15. The device of claim 11, wherein there is a respective common tie rod connecting the ends of the adjacent leaf springs where they overlap to the support.

16. The device of claim 15, wherein the individual leaf spring is substantially trapezoidal in shape, the ends of adjacent ones of the leaf spring overlap each other laterally; a common spring clamping plate over the overlapping ends, and the common tie rod acting on the spring clamping plate over the overlapping ends.

17. The device of claim 1, wherein the clamping means comprises an expandable hose extending over substantially the entire width of the device, first tie means between the hose and the cover ledge and second tie means between the hose and the support whereby a change in expansion of the hose, through the first and second tie means, establishes the orientation angle of the cover ledge and the drainage surface thereof.

18. The device of claim 17, wherein the first tie means comprises a movable force transmission ledge at one side of the hose and first tie rods connecting the movable force transmission ledge to the cover ledge;

the second tie means comprises a second force transmission ledge at the other side of the hose and second tie rods connecting the stationary force transmission ledge to the support.

19. The device of claim 1, wherein one of the first and second stop means comprises a wedge ledge which extends over the width direction of the device and the wedge ledge is supported for displacement across the width with respect to the respective one of the cover ledge and the support on which the wedge ledge is disposed, the wedge ledge having a plurality of stop surfaces defined on it; the other of the first and second stop means comprising a respective slide disk for slidingly engaging the stop surfaces of the wedge ledge.

20. The device of claim 19, further comprising a respective connecting joint connecting each of the slide disks to the respective one of the cover ledge and the support, and the connecting joint comprising means enabling the orientation of the stop disk to automatically adjust itself to the orientation of the stop surface on the wedge ledge for enabling wedging contact between the slide disk and the respective wedge ledge stop surface.

21. The device of claim 20, wherein the joint between the slide disk and the respective one of the cover ledge and the support to which the slide disk is supported comprises a ball and socket joint for enabling the slide disk to rotate to a mating orientation with the wedge disk stop surface.

* * * * *